US005819603A

United States Patent [19]

Murray

[11] Patent Number: 5,819,603

[45] Date of Patent: Oct. 13, 1998

[54] ROOF SHINGLE REMOVER

[75] Inventor: Iva Yvonne Murray, 9 Howd Ave., Stony Creek, Conn. 06405

[73] Assignee: Iva Yvonne Murray, Stony Creek, Conn.

[21] Appl. No.: 822,878

[22] Filed: Mar. 24, 1997

[51] Int. Cl.[6] ..... E04D 15/00

[52] U.S. Cl. ..... 81/45; 30/169

[58] Field of Search ..... 81/45; 254/131.5, 254/131, 53.5; 30/169; 15/93.1; 294/54.5

[56] References Cited

U.S. PATENT DOCUMENTS 4,537,433 8/1985 Yang ..... 254/131.5
4,663,995 5/1987 Amundson et al. ..... 81/45
4,763,547 8/1988 Dike, Jr. ..... 81/45
5,001,946 3/1991 Shirlin et al. ..... 81/45
5,159,859 11/1992 Whitesell ..... 81/45

*Primary Examiner*—David A. Scherbel
*Assistant Examiner*—Joni B. Danganan

[57] ABSTRACT

The present invention is a tool designed for removal of shingles from a roof, capable of working in between spacers commonly found on conventional roofs. In use, the tool is inserted in between the shingle layers, at which time the trigger is squeezed releasing the lifter plate latch. When the handle is then pushed downward, the lifter plate is raised by means of a fulcrum force, creating a leveraged lift against the shingle layers and thereby separates the shingles up and away from the roof substrate.

2 Claims, 4 Drawing Sheets

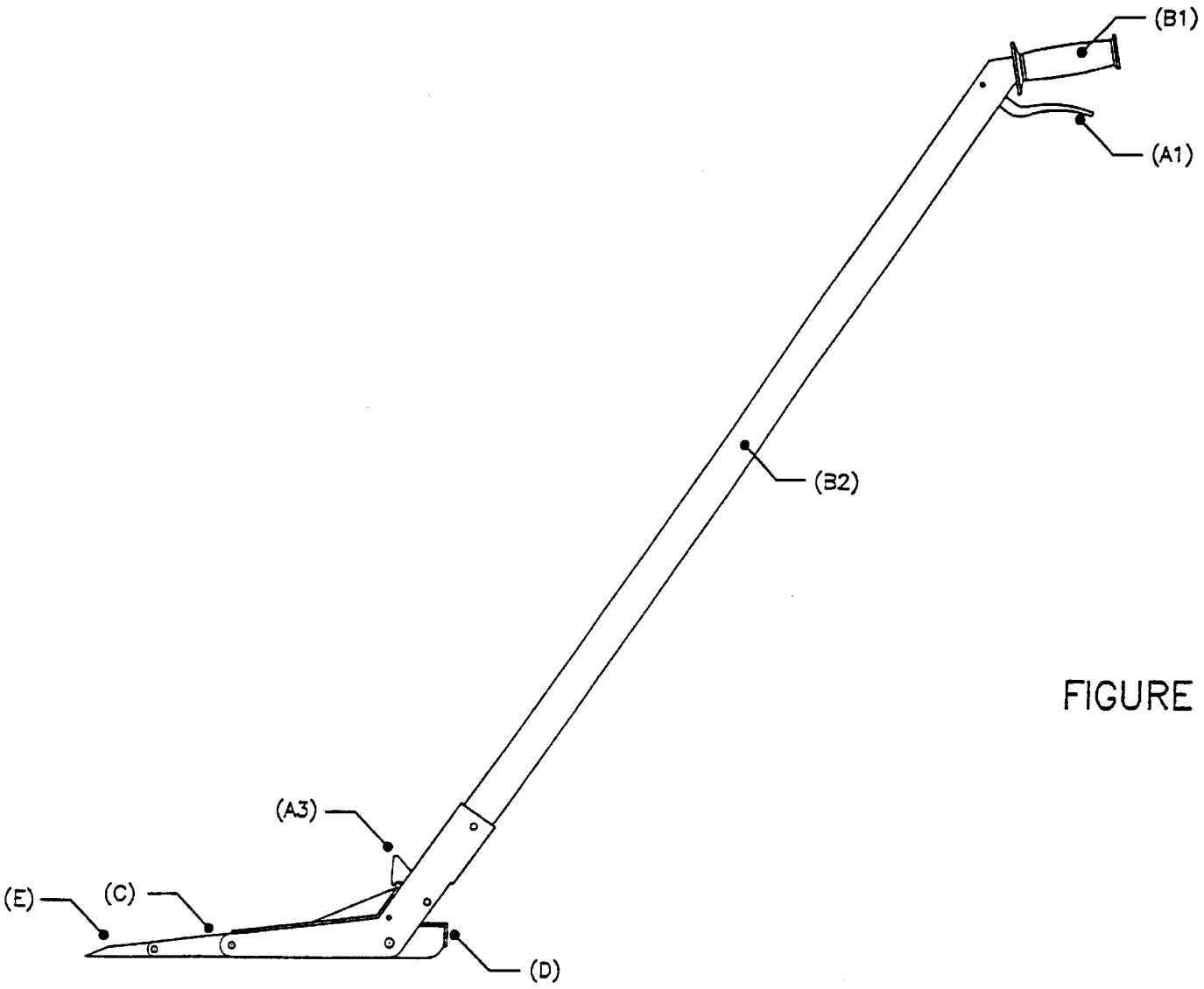
FIGURE #1 SIDE VIEW

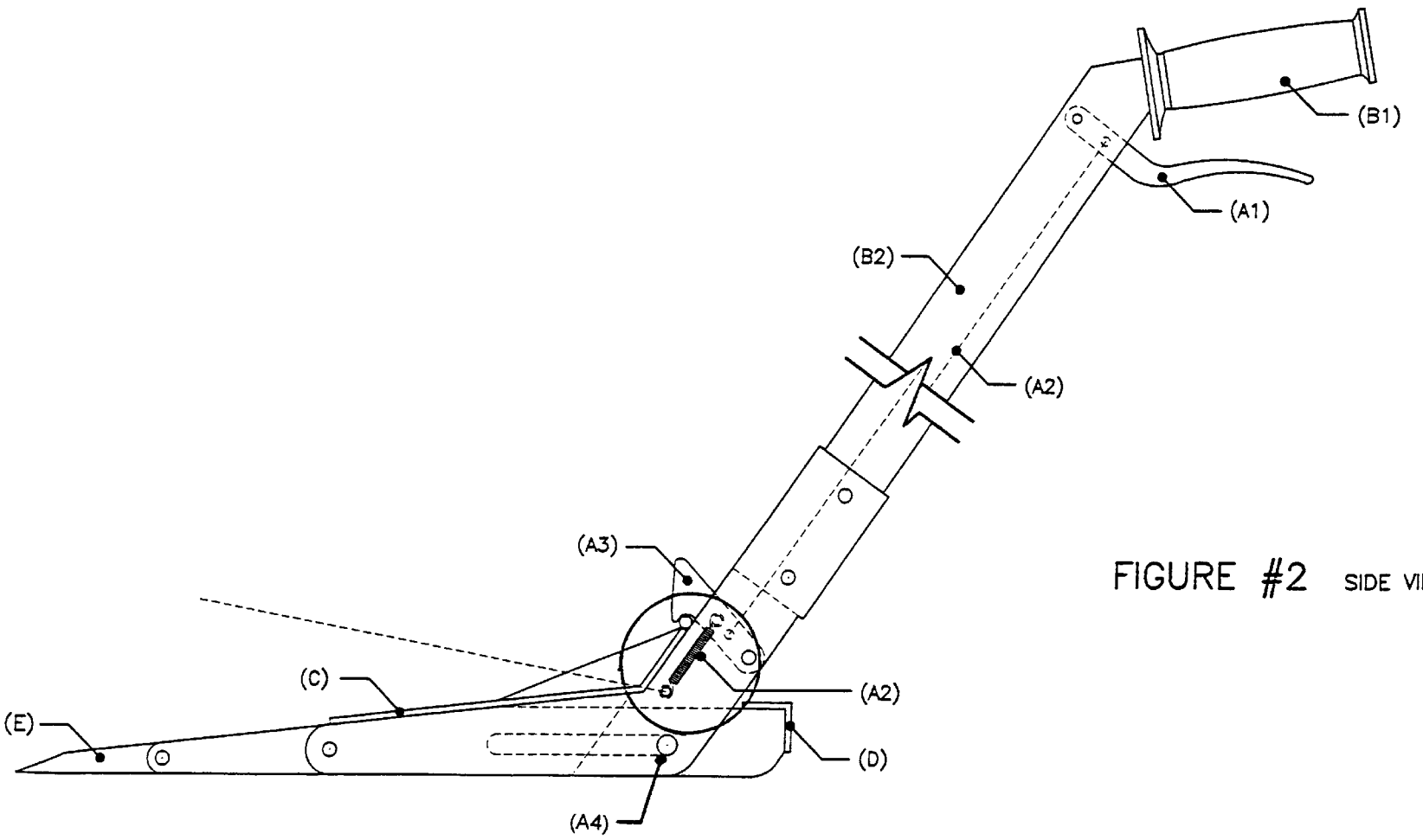
FIGURE #2 SIDE VIEW

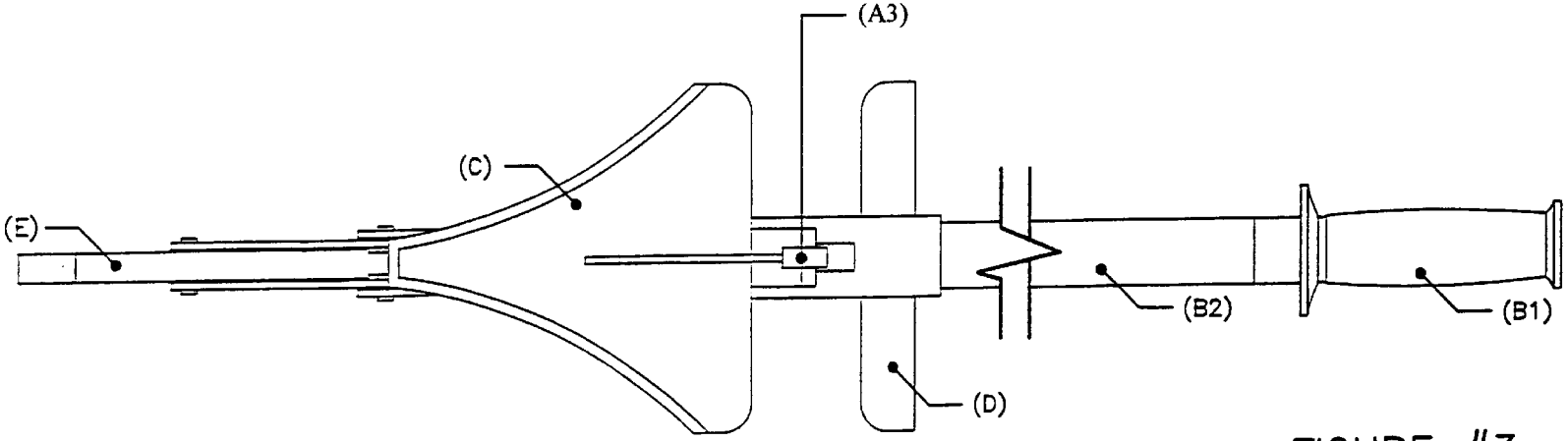
FIGURE #3 TOP VIEW

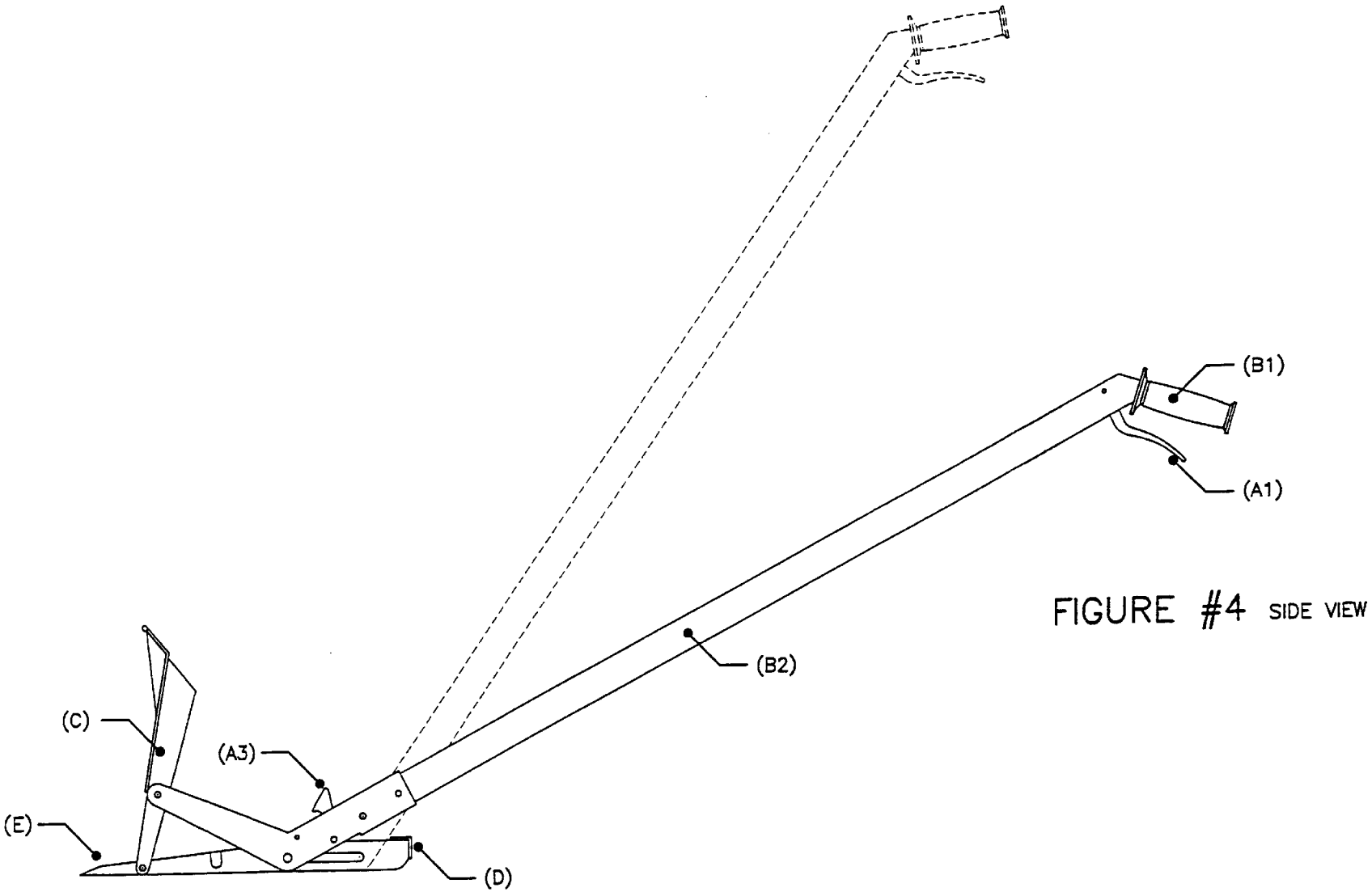
FIGURE #4 SIDE VIEW

ROOF SHINGLE REMOVER

BACKGROUND OF THE INVENTION

This invention is related to apparatus for stripping roof shingles and nails.

Roof shingles are currently being removed with common carpentry and yard tools that make it very difficult and unsafe for the Contractor.

SUMMARY OF THE INVENTION

The broad purpose of the present invention is to provide an improved hand-operated, roof stripping apparatus. The invention, which will be described in further detail, comprises of a tubular bar with a handle at the upper end and a lifting plate at the other end designed for insertion between roof purlins commonly found on pitched roofs. Purlins, also known as skip sheathing, are the wood timbers that are equally spaced and run parallel to the ridge and horizontally across the roof which is seen prior to the application of shingles. These are equally spaced from the ridge of the roof to the bottom edge with air space between them to prevent condensation build up. Shingles are applied on the purlins, in rows across the roof. When shingles need to be removed, this invention gets in between the purlins as it works its way across the roof, row by row. The fulcrum on the heel of the tool rests on either side of the purlins, and this enables the tool to get in between the purlins and underneath the shingle layers with its spade shaped lifter plate and chisel point. With leverage applied by pushing down on the handle, the plate lifts the shingles up from the purlins and away from the operator. All patents investigated by the inventor of the present apparatus do not appear to have the same features and abilities.

This apparatus utilizes a cable release means, actuated by pressing a lever at the handle. When the spade-shaped plate is driven in between roof purlins, the handle lever is squeezed that releases the plate latch. Once the latch is away from the plate's rear notch, the tool can now be pushed downward which by mechanical linkage fulcrums the plate in an upward arc and thereby exerts a leverage force in removing the roof shingles.

THE DESCRIPTION OF THE DRAWINGS

The description refers to the accompanying drawings in which like characters refer to like parts throughout the several view, and in which:

FIG. 1 is a side view of a preferred shingle stripping apparatus illustrating the preferred embodiment of the invention.

FIG. 2 is a side view of a preferred shingle stripping apparatus illustrating details of the upper handle assembly and the lower plate with its latching means.

FIG. 3 is a top view of a preferred shingle stripping apparatus illustrating the spade-shaped lower plate with its and chisel-point used for inserting the device in between the roof purlins at the rear fulcrum.

FIG. 4 is a side view of a preferred shingle stripping apparatus illustrating the tool in its beginning and ending position with the lower plate being released and rotated upwards.

DESCRIPTION OF THE PREFERRED EMBODIMENT

Referring to the drawings, FIG. 1 illustrates a roof shingle removing apparatus comprising of a handle shaft (B2) having its upper end bent to form handle (B1). Beneath the handle is a trigger (A1). At the base is the lifter plate (C) with its trigger latch (A3). Connected to the lifter plate (C) is the chisel-point (E) and at the rear of the lifter plate (C) is the fulcrum (D).

FIG. 2 illustrates a roof shingle removing apparatus shown in a compressed view, comprising of a handle shaft (B2) having its upper end bent to form a handle (B1). Beneath the handle is a trigger (A1). At the base is the lifter plate (C) with its trigger latch (A3). The cable, which runs through the center of the handle shaft (B2), is connected to the trigger latch (A3) which is connected to the trigger cable and spring (A2). Connected to the lifter plate (C) is the chisel point (E) and at the rear of the lifter plate (C) is the fulcrum (D). When the trigger latch (A3) releases the lifter plate (C), the handle (B1) is pushed downward, causing the lifter plate (C) to slide forward by means of the pin and slot (A4) and upward by means of the fulcrum (D).

FIG. 3 illustrates a roof shingle removing apparatus shown in a top compressed view, comprising of a handle shaft (B2) having its upper end bent to form a handle (B1) (as seen from the top). The top view of the lifter plate (C) shows the spade shape and the chisel point (E) designed for getting in between the roof purlins. The fulcrum (D) serves to support the rear of the lifter plate (C) when the handle (B1) and shaft (B2) is pushed downward, resulting in the lift plate (C) being moved in an upward and forward arc.

FIG. 4 illustrates a roof shingle removing apparatus shown in a side view, comprising of a handle shaft (B2) having its upper end bent to form a handle (B1). The dotted lines illustrate the view the tool in the raised position as it would be when the lifter plate (C) is inserted in between the roof purlins. The solid lines illustrate the view of the tool when it is pushed downward, resulting in the lifting action of the plate. The trigger (A1) is squeezed which by internal leverage pulls the trigger latch (A3) by means of the inside cable (shown in FIG. 2 at (A2)), thereby freeing the lifter plate (C) to be slid forward and raised which lifts the roof shingles up and away from the tool.

Function:

In use, the tool is grasped with one hand on Handle (B1) and the other hand midway down the Handle Shaft (B2) (see FIG. #1). The Chisel Point (E) is inserted between the roofing and substrate with the Trigger Mechanism (A1, A2 and A3) in the locked position. The user then squeezes Trigger (A1), thus unlocking Lifter Plate (C) while simultaneously pushing the Handle (B1) downward, thus rotating the Lifter Plate (C) to its extreme position (see FIG. #4).

The upward rotation of the Lifter Plate (C) separates the worn roofing material from the substrate. The operator then returns the Handle (B1) to its original position and slides the tool forward, beneath the already loosened roofing, and repeats the process of pushing the Handle (B1) downward, returning Handle (B1) to its original position, then sliding the tool forward. The repeated cycle of upward and downward motion of the Handle (B1) and B2) as the tool is advanced forward allows the Lifter Plate (C) to separate the worn shingles from the substrate and push the stripped shingles forward and away from the user.

I claim:

1. A roof shingle stripping device for removing shingles from a roof with purlins or spacers, comprising:

an elongated tubular body having an upper end and a lower end;

a handle mounted on the upper end of the tubular body;

a trigger mounted on the tubular body below the handle and connected to a first end of a cable running within the tubular body;

a trigger latch mounted to the lower end of the tubular body and connected to a second end of the cable, said trigger latch normally holding a lifter plate in a closed position;

said lifter plate having a spade-shaped body and pivotally connected to a stationary member having a chisel point at a first end for insertion between the purlins or spacers and a transverse fulcrum at a second end; and a pivot means for pivotally connecting the lower end of the tubular body to the lifter plate such that by releasing the trigger latch and pushing down on the handle, the lifter plate slides forward and upward from said transverse fulcrum to raise the shingle from the roof.

2. A roof shingle stripping device as in claim 1, wherein the pivot means includes a transverse pin through a lowered end of the tubular body and elongated slot on the stationary member, wherein the pin is slidingly engaged within the slot.

* * * * *